US007661715B2

(12) United States Patent
Porat

(10) Patent No.: US 7,661,715 B2
(45) Date of Patent: Feb. 16, 2010

(54) BOOKS AND BINDING METHOD

(75) Inventor: Thomas Porat, 1 Huckabee Farm Rd., Amherst, NH (US) 03031

(73) Assignee: Thomas Porat, Amherst, NH (US)

( * ) Notice: Subject to any disclaimer, the term of this patent is extended or adjusted under 35 U.S.C. 154(b) by 652 days.

(21) Appl. No.: 11/005,202

(22) Filed: Dec. 6, 2004

(65) Prior Publication Data

US 2006/0119093 A1 Jun. 8, 2006

(51) Int. Cl.
*B42D 1/08* (2006.01)

(52) U.S. Cl. ..... 281/21.1; 281/38; 402/79; 412/7

(58) Field of Classification Search ..... 428/43, 428/136, 137; 206/575, 224, 232; 281/21.1, 281/2, 3.1, 15.1, 29, 38, 26, 40, 41, 45–48; 402/70, 73, 57, 79, 80 R; 412/1, 6, 7, 8; 283/61, 62, 63.1; 156/305, 291; 462/78, 462/13, 17, 55, 53, 25, 18; *B42D 1/06, 3/00*
See application file for complete search history.

(56) References Cited

U.S. PATENT DOCUMENTS

| | | | | | |
|---|---|---|---|---|---|
| 307,817 | A | * | 11/1884 | Tapley | 24/703.5 |
| 649,061 | A | * | 5/1900 | Leechman | 281/40 |
| 952,638 | A | * | 3/1910 | Rice | 462/18 |
| 1,551,142 | A | * | 8/1925 | Franz, Jr. | 281/40 |
| 1,970,285 | A | | 8/1934 | Douvry | |
| 2,136,186 | A | | 11/1938 | Frost | |
| 2,226,765 | A | * | 12/1940 | Goodell | 281/26 |
| 2,236,169 | A | * | 3/1941 | Dunwoodie, Sr. | 281/27.2 |
| 2,257,714 | A | | 9/1941 | Emmer | |
| 3,159,411 | A | | 12/1964 | McKowen | |
| 3,393,925 | A | * | 7/1968 | Bertram | 462/57 |
| 3,794,550 | A | * | 2/1974 | Taillie | 281/21.1 |
| 4,039,046 | A | * | 8/1977 | D'Luhy | 462/55 |
| 4,248,457 | A | * | 2/1981 | Torbeck | 462/13 |
| 4,351,546 | A | * | 9/1982 | Cognata | 281/45 |
| 4,357,380 | A | * | 11/1982 | Schnug | 428/138 |
| 4,682,792 | A | * | 7/1987 | Simmons | 281/45 |
| 4,902,183 | A | | 2/1990 | Vercillo et al. | |
| 5,143,502 | A | | 9/1992 | Kaufmann et al. | |
| 5,207,456 | A | | 5/1993 | Danhoff | |
| 5,273,387 | A | | 12/1993 | Groswith et al. | |
| 5,330,229 | A | | 7/1994 | Zoltner | |
| 5,599,045 | A | | 2/1997 | Asai et al. | |

(Continued)

FOREIGN PATENT DOCUMENTS

| | | |
|---|---|---|
| GB | 20248 | 0/1909 |

(Continued)

OTHER PUBLICATIONS

International Search Report for PCT/US2005/043886 mailed on May 3, 2006, 7 pages.

(Continued)

*Primary Examiner*—Dana Ross
*Assistant Examiner*—Jamila Williams
(74) *Attorney, Agent, or Firm*—Grossman Tucker Perreault & Pfleger PLLC

(57) ABSTRACT

A method and apparatus for binding a stack of sheets. The stack may form a book and may have a binding region about which a binder can be clamped.

15 Claims, 19 Drawing Sheets

U.S. PATENT DOCUMENTS

| | | | | |
|---|---|---|---|---|
| 5,865,469 | A * | 2/1999 | Chin | 281/45 |
| 5,941,569 | A | 8/1999 | Solomons | |
| 6,270,280 | B1 | 8/2001 | Baumann | |
| 6,371,520 | B1 | 4/2002 | Wolff et al. | |
| 6,641,345 | B2 * | 11/2003 | Cobene et al. | 412/1 |
| 6,663,311 | B1 | 12/2003 | Ong | |
| 6,692,208 | B1 * | 2/2004 | Watkiss et al. | 412/1 |
| 6,964,537 | B1 * | 11/2005 | Ong | 402/14 |
| 2002/0064436 | A1 | 5/2002 | Marsh | |
| 2006/0061083 | A1 * | 3/2006 | Didde | 281/21.1 |

FOREIGN PATENT DOCUMENTS

| | | | | |
|---|---|---|---|---|
| GB | 1202906 | A3 | | 8/1970 |
| GB | 2145033 | A | * | 3/1985 |
| GB | 2260513 | A | * | 4/1993 |
| JP | 2003300392 | A | * | 10/2003 |
| WO | WO 2005/023555 | | | 3/2005 |
| WO | WO 2005/023555 | A2 | | 3/2005 |

OTHER PUBLICATIONS

Written Opinion of the International Searching Authority mailed on May 3, 2006,9 pages.

European Examination Report dated Mar. 7, 2008 issued in corresponding European Patent Application No. 05852946.2.

* cited by examiner

BOOKS AND BINDING METHOD

FIELD OF THE INVENTION

The present invention is related to books and a method of binding books, and, in particular, to a method of binding a stack of sheets to form a book.

DESCRIPTION OF THE RELATED ART

Methods of binding printed pages together to form books, pamphlets, booklets, calendars and the like are well known. Some of these methods are used primarily in high production techniques such as high volume book publishing. Other methods may be more appropriate for short run productions, such as reports, theses, brochures and short run book publications. Short run binding is often done in homes, schools or places of business that do not specialize in book binding.

Binding techniques directed to short run applications include, for example "curled finger" type bindings such as those sold by General Binding Corporation (GBC) and clamping type report covers that serve to secure a cover to a stack of sheets.

The curled finger type of binding was first described by Douvry in U.S. Pat. No. 1,970,285 that discloses perforating a stack of sheets of paper and binding the sheets of paper together by passing resilient curled fingers through the perforations. A solid spine to which the curled fingers may be connected keeps the fingers, and thus the resulting book, together. Machines for punching the perforations in the paper and for extending the curled fingers through the perforations are described in, for example, U.S. Pat. Nos. 4,902,183, 5,273,387 and 5,143,502.

Short run binding techniques that do not require perforation of the sheets of paper include report covers, typically with a resilient sliding binder, such as those described in U.S. Pat. Nos. 6,371,520 and 6,663,311. This type of binder works, in general, by placing a stack of sheets inside a hinged paper or plastic cover material and sliding a resilient binder over the spine of the report cover. The compression provided by the binder serves to keep the pages in place without the use of an adhesive or the need to perforate the pages.

These clamping type report covers may include binders made for a variety of thicknesses of sheets so that the binder can be extended over the stack of sheets and still provide adequate pressure to retain the sheets inside. However, this binding technique may be most useful on a temporary basis and is much less permanent than some binding methods, as papers may be pulled from the stack by applying moderate tension to one or more of the sheets. Papers can be added or removed by removing and replacing the binder.

Both the curled finger type binder and the clamping report cover provide a finished product that has a temporary appearance and lacks the look of a finished book, such as a traditional hard or soft cover book.

Binding methods that can be used in short run binding operations, yet provide a more permanent and secure product that more closely resembles a traditional hard or soft cover book would be well received in the field.

SUMMARY OF THE INVENTION

The subject matter of this application may involve, in some cases, interrelated products, alternative solutions to a particular problem, and/or a plurality of different uses of a single system or article.

In one aspect, the invention relates to a book comprising a stack of sheets, the stack having a thickness, a binding edge and an opposed non-binding edge, a binding region defining a cross section through the thickness of the stack and substantially parallel to and proximate the binding edge, the binding region having a first stack density, and a second region passing through the thickness of the stack between the binding region and the binding edge, the second region having a second stack density, the second stack density being greater than the first stack density.

In another aspect, the invention relates to a method of binding, the method comprising steps of providing a first sheet having a first binding edge and a first pattern of perforations proximate the binding edge, providing at least a second sheet having a second binding edge and a second pattern of perforations proximate the binding edge, the second pattern being different from the first pattern, stacking the first sheet and the second sheet together to form a stack, and clamping the stack at a portion of overlap between the first pattern and the second pattern.

In another aspect, the invention relates to a book, the book comprising a stack of sheets having a top sheet and a bottom sheet, a first region of the stack having a first thickness and a second region having a second thickness that is less than the first thickness, the second region extending substantially from a first edge of the book to a second opposed edge of the book, and a binder applying pressure to the top and the bottom of the stack of sheets at one or more points along the second region.

In another aspect, the invention relates to a stack of paper, the stack comprising a first sheet having a first pattern of perforations, and a second sheet having a second pattern of perforations that is a different pattern from the first sheet and wherein when the first and second sheet are stacked with edges in alignment, the first and second patterns are at least partially misaligned.

In another aspect, a kit for producing a book is provided, the kit comprising a plurality of sheets of paper, at least some of the sheets including a region that, when the sheets are stacked together, forms a binding region, and a binder for binding the stack at the binding region.

In another aspect, another kit for producing a book is provided, the kit comprising a plurality of sheets of paper, at least some of the sheets including a region that, when the sheets are stacked together, forms a lay open region, and a binder for binding the stack into a book.

In another aspect, a book is provided, the book comprising a lay open region.

In another aspect, a method of making a book is provided, the method comprising placing a plurality of sheets into a stack, at least some of the sheets including a lay open region, and binding the stack to form a book.

Other advantages, features, and uses of the invention will become apparent from the following detailed description of non-limiting embodiments of the invention when considered in conjunction with the accompanying drawings, which are schematic and which are not intended to be drawn to scale. In the figures, each identical or nearly identical component that is illustrated in various figures typically is represented by a single numeral. For purposes of clarity, not every component is labeled in every figure, nor is every component of each embodiment of the invention shown where illustration is not necessary to allow those of ordinary skill in the art to understand the invention. In cases where the present specification and a document incorporated by reference include conflicting disclosure, the present specification shall control.

DETAILED DESCRIPTION

Figure 1:
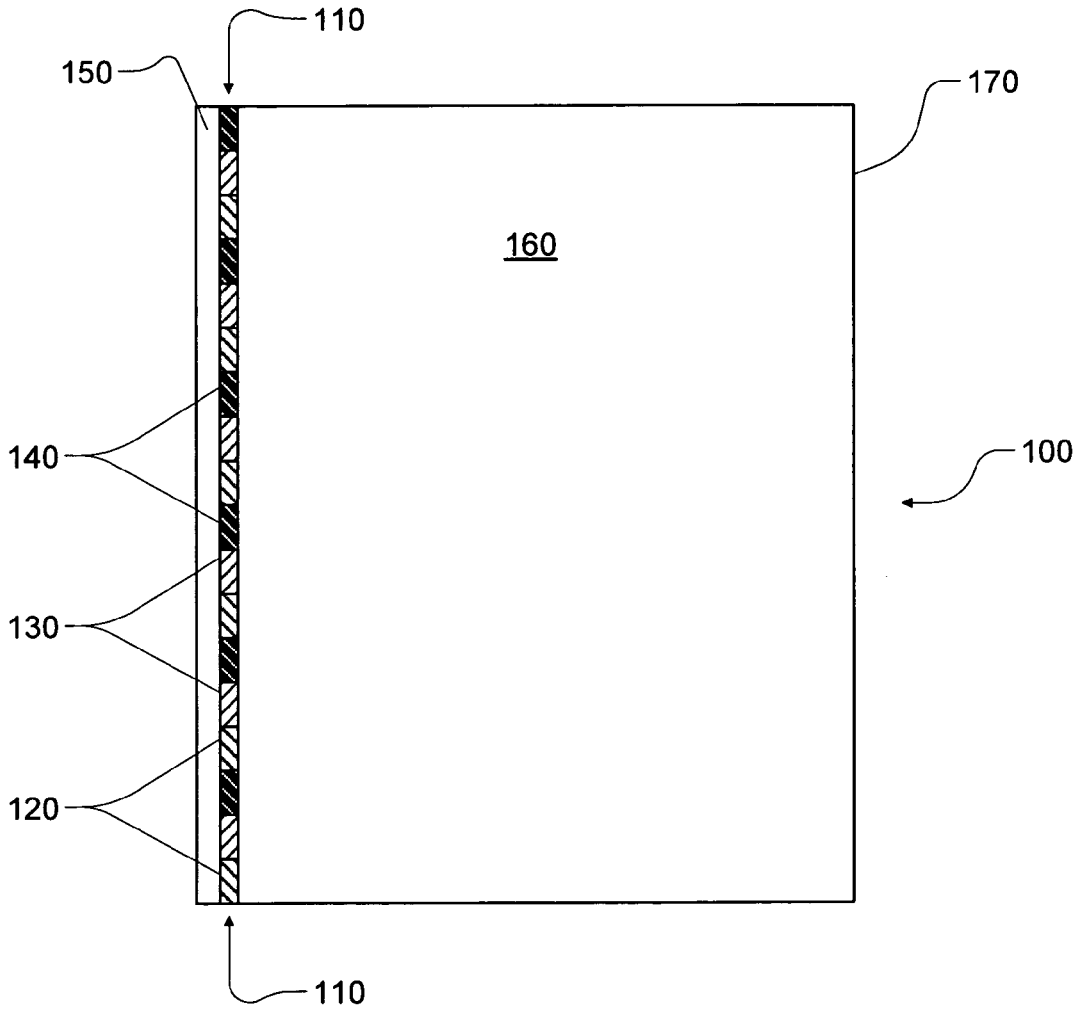
FIG. 1 provides a top view of a sheet having three possible perforation patterns to form a binding region.

In one aspect of the invention, a method of binding a stack of sheets together to form a book is provided. The method may include clamping the stack of sheets at a binding region to secure the sheets in place. The resulting book may be permanent and durable and may include a finish giving the appearance of a traditionally bound soft or hardcover book.

In another aspect, the invention is directed to a book. The pages of the book may be held together with a binder that applies pressure across a stack of sheets at a binding region. The binding region may have a thickness that is less than the thickness of one or more different areas of the stack of sheets, thus allowing the binder to be closed to a greater extent than if the binding region was not of a reduced thickness.

A "binder" is a device used to compress or clamp a stack of sheets together and to maintain the relative position of the sheets. The binder may be rigid or flexible and is typically made of metal or plastic.

As used herein, the term "book" means a book as it is conventionally defined and also includes additional bound printed objects such as calendars, pamphlets, brochures, reports, etc.

A "sheet" is used herein to mean a printable surface that can be used to form the pages of a book and is typically made out of paper, although other materials such as plastics may also be used. Sheets can be of any shape but are typically rectangular and have a length, width and thickness.

The term "perforation" is used herein to mean an aperture that passes through the thickness of a sheet. Perforations may be round, oval, rectangular, square or any other shape.

A "binding region" is, for example, a region of a stack of sheets that, when compressed by a binder, is of reduced thickness compared to another region of the stack under the same compression pressure. The binding region may be of equal thickness to other regions of the stack when no pressure is applied. A binding region may be of any shape although it is typically long and narrow and oriented parallel to the spine of the finished book. The binding region can be formed for example, by reducing sheet or stack density in the region or by using sheets having regions of distinctly different thicknesses. When referring to the binding region of a single sheet, the binding region of the sheet is that region of the sheet that forms the binding region of a stack when the sheet is stacked together with additional sheets.

"Stack density" is a term used herein to describe the amount of material, eg, paper, in a stack of sheets or a region of a stack of sheets. Stack density is typically measured or evaluated across a particular cross-section of a stack of sheets, for example, across a binding region of a stack of sheets. A lower stack density means that the region of the stack referred to, e.g., a binding region, has a reduced amount of sheet mass when compared to another section of the stack. A binding region of a stack typically has a lower stack density than do other regions of the same stack when the binding region is not under compression. When the binding region is compressed, the stack density in the compressed area may increase and can be equal to greater than the stack density in the non-binding regions of the stack.

Stack density at a region of a stack can be reduced, for example, by removing regions of the corresponding region from individual sheets such as by perforating or grinding or by producing paper having an area of reduced density or thickness. This may be done, in some cases, during the production of the sheet. Stack density can also be varied by folding back one or more portions of a sheet. A reduction in stack density in a particular region generally means that the region will be of reduced thickness when compressed, although upon compression, the density of the region may increase.

"Sheet density" describes the amount of sheet material (mass) in a sheet or region of a sheet. For example, a perforated region of a sheet may have a lower sheet density than does a non-perforated region of the sheet. Sheet density may be increased by adding mass, such as, for example, by the addition of an adhesive, or by increasing the amount of material, such as by folding portions of the sheet back on itself The methods of the invention may be used to produce a book being bound with a binding that is secure and, if desired, permanent. The book may be bound in runs of low quantity and can be done with minimal or no equipment in, e.g., an office, school or home by those with little or no binding experience. By binding a stack of sheets in a region of lower stack density than other parts of the stack, the binding may be able to secure the pages to a greater degree than when using previously known techniques.

In one embodiment when a stack of sheets includes a series of sheets that have overlapping but misaligned perforation patterns a binding region results. The resulting binding region can provide for an area of reduced thickness and decreased stack density. As the sheets are compressed together at the binding region, for example, by the clamping action of a binder, the perforations in a sheet may become intertwined with the non-perforated sections of an adjacent sheet. As paper from one sheet fills the perforations of an adjacent sheet when pressure is applied, the sheets may become interlocked. This merging of paper from one sheet with a perforation or portion of a perforation of an adjacent ( or other) sheet can provide for a binding region of reduced thickness in the stack. As a perforation is filled with paper from another sheet, the void that typically defines the perforation can be partially or totally filled with paper from the other sheet. The result is that the overlapping region (binding region) of perforation patterns collapses to a reduced thickness. In theory, if every perforation is filled with paper from another sheet, the resulting reduction in thickness would be approximately equal to the percentage of voids in each sheet in the binding region. For example, if a binding region extends for 10 inches along an 11 inch long sheet and if, for each sheet, 2.5 inches of the 10 inches is perforated, then upon compression of the binding region, the thickness of the region would be about 25% less than the thickness of an unperforated region of the stack. This assumes that each sheet of the stack has a perforation pattern that does not overlap with the perforation pattern of an adjacent sheet. If there is some overlap between perforations of adjacent sheets, it may be the case that not every perforation will be filled, and as a result, the reduction in thickness may not be as great.

Figure 2:
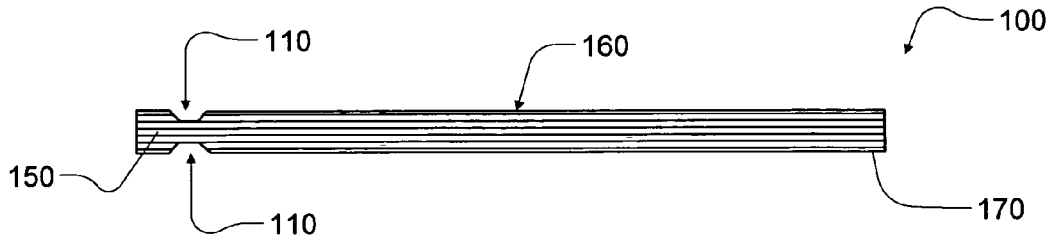
FIG. 2 provides a cross-sectional or end view of a stack of sheets including a binding region.
Figure 3:
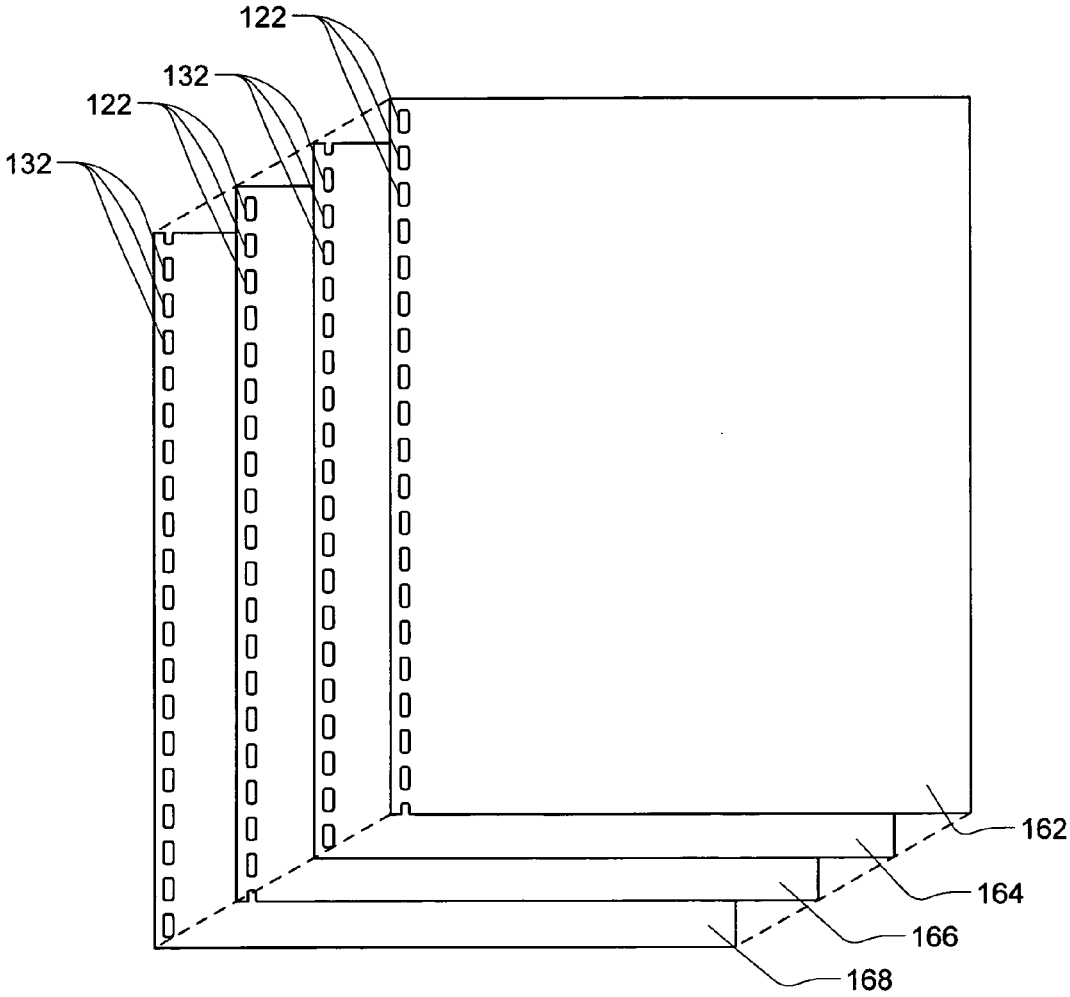
FIG. 3 provides an exploded view of four sheets exhibiting two different perforation patterns to form a binding region.

One method of producing a book using a method of the invention is illustrated in FIGS. 1, 2 and 3. FIG. 1 provides a top view of a stack of sheets to be bound into a book. Stack of sheets 160 is composed of any number of sheets 162, 164, 166, etc., that can be stacked one on top of the other. Individual sheets may contain a region 110 of perforations. Perforations may be in a specific pattern such as those represented by perforations 120, perforations 130 or perforations 140. A specific sheet in the stack would typically be perforated according one of patterns 120, 130 or 140, but would not include more than one of these patterns. An adjacent sheet, that is, a sheet directly above or below the specific sheet, would typically be perforated with a different pattern, as might a third sheet. For example, a first sheet might include pattern 120, while a second sheet would include pattern 130 and a third sheet would include pattern 140. Two such adjacent sheets are shown in FIG. 3, in exploded form. The two sheets show perforation patterns having the same size perforations at the same intervals. Pages 162 and 166 exhibit the same perforation pattern as do pages 164 and 168. The perforation pattern on all of the pages can be made by the same punching or perforating process as sheet 164 is the same as 162 except that it has been turned over. Likewise, 166 and 168 are the same except that one of the pages has been turned over. Therefore, two different perforation patterns can be made by perforating sheets equally and then turning one of them over. In the case illustrated in FIG. 3, when the sheets are stacked together the resulting perforations will overlap but will be misaligned. The misaligned perforations provide for a binding region when the sheets are stacked together. It may be preferred that the stack includes sheets alternating with different perforation patterns so that no or few adjacent sheets include the same pattern. By alternating the pattern in adjacent sheets the resulting binding region in the stack can be compressed to a greater degree than if adjacent sheets or multiple adjacent sheets exhibit the same perforation pattern. Stacks or reams of paper may be manufactured, packaged and/or sold with adjacent sheets exhibiting different perforation patterns. By supplying reams of paper that include different sheets having two, three, four or more perforation patterns, the paper may be directly fed to a printing process, e.g., a laser printer, so that pages are printed in an order that provides for a stack of sheets having alternating perforation patterns and a resulting binding region. Of course, sheets can also be collated at the time of printing.

In the embodiment shown in FIG. 1, perforation patterns may include staggered perforations so that any sheet perforated according to pattern 120 includes no perforations that are completely aligned with the perforations in a sheet perforated with pattern 130 or 140. Thus, a stack including a plurality of sheets having different patterns of perforations may include a region 110 in which some or all of the sheets are perforated without any particular alignment of perforations passing entirely through the stack, i.e., if one were to hold the aligned stack of sheets up to light, there would be no regions in section 110 through which light would freely pass. Of course, in some cases there may be sections of binding region 1 10 having perforations passing completely through the stack, but it is preferable that these pass-through perforations are not so extensive that the sheets of the stack are provided with a weakened tear point that would allow for pages to be torn from the binder at this region. By alternating the perforation patterns between adjacent sheets, weak points can be minimized because any adjacent group of pages will not have aligned tear points, e.g., a point at which a perforation passes entirely through the stack of sheets.

Although there may be no section of the stack 160 that includes perforations that pass entirely through the stack (although there can be, without detracting from the essence of the invention), the staggered patterns provide a region 110 of lower stack density (before compression) than either binding edge 150 or open edge 170. For example, as shown in FIG. 2, if each sheet in the stack is perforated over one third of the length of region 110 (shown in a compressed state) when the sheets are stacked together and compressed, such as with a binder, region 110 of the stack will have a thickness that is about one third less than in either region 150 or 170. There can be "less paper" in the binding region, by weight and/or volume and/or area, over a given binding region area, than in other regions. In this case, about ⅓ less paper. To put this another way, region 110 includes portions of a stack at a lower stack density (when uncompressed) than does either region 150 or region 170. Upon compression, this results in reduced thickness which is visible in FIG. 2 and provides a post-compression end view of the stack of sheets shown in FIG. 1. Region 110 is noticeably thinner than either region 150 or region 170. In this embodiment, each sheet of the stack passes through region 110. Typically, there is no sheet that is entirely cut at the binding region. However, the alternate perforations in adjoining sheets provide for less sheet material in this region and, as a result, can provide for a lower stack density before compression and decreased thickness after compression. When compressed, this region forms a valley or trough in which a binder can securely bind the stack of sheets.

Figure 4:
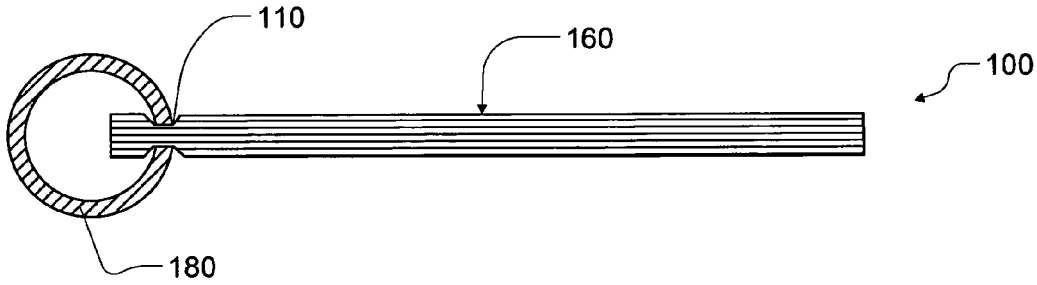
FIG. 4 provides an end view of a stack of sheets including a binding region compressed by a binder.

FIG. 4 provides a view similar to that of FIG. 3 after a binder has been applied to the stack to provide a binding force. The binder 180 may be of any shape and in this case is cylindrical with a longitudinal split extending lengthwise from one end of the tube to the other. The tube 180 is of a resilient material and can be pried open to fit over the stack of sheets. When released, the resilient binder can provide clamping pressure to the stack of sheets 100 at binding region 110.

Figure 5:
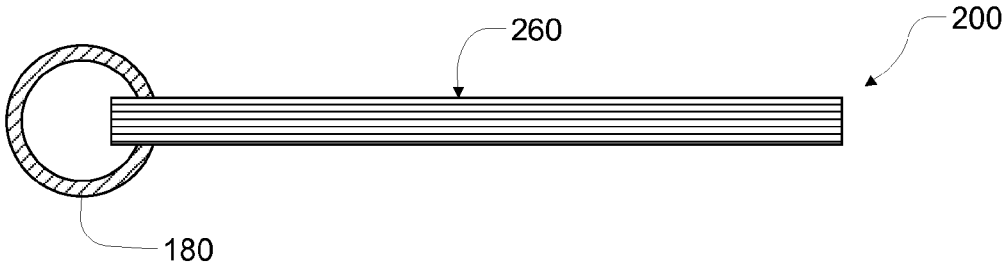
PRIOR ART FIG. 5
FIG. 5 provides an end view of a prior art book not including a binding region.

As binding region 110 is of a reduced thickness when compared to the rest of the book and contains sheets having lower sheet densities in this region, binder 180 can provide a particularly strong binding that may prevent or discourage the removal of individual sheets from the book. This can be contrasted to a prior art binding as shown in FIG. 5. In the prior art, the stack of sheets is of constant stack density when uncompressed and of substantially constant thickness across the width of the stack, even after compression. A resilient binder 180 may be, in some cases, identical to the binder shown in FIG. 4 and may be used to provide pressure to stack 200 to keep the sheets in book form. However, because the prior art stack is of constant stack density across the entire stack, the binder cannot close to as great a degree and is much less effective at providing a permanent binding. Therefore, sheets can typically be removed by pulling on one or more of them individually. Even if sheets are not pulled out, they may become partially misaligned so as to make the pages of the book uneven. The binder may also slide off of the pages because there is little or no indentation to provide purchase for the binder. In contrast, the binding region of the book of FIG. 4 provides an indentation of decreased thickness that forms a groove to retain the binder in position, even when a sliding force is applied to the binder along its axis. Sheets may also be kept aligned in relation to each other because, for example, the clamping action around the binding region of decreased thickness can prevent any shifting of individual sheets in relation to the binding. Sheets may also be kept in alignment with each other due to, in part, the interaction of perforated regions as discussed above.

A binding region in a stack of sheets can be formed either before or after the sheets are arranged into the stack. In some embodiments, the individual sheets that comprise the stack may include a binding region before the stack is formed and bound. Individual sheets may be unperforated yet can include a portion or portions of decreased thickness that, when stacked with additional sheets, form a region in the stack of decreased thickness, thus providing a binding region. The decreased thickness portions may be in a pattern, similar to that described previously for perforated pages, or may be a continuous portion, or a combination of a pattern and a continuous portion. Such portions of decreased thickness may be formed by removing material from the area such as by grinding or scraping. Alternatively, the sheet may be produced with a region of deceased thickness. For example, a paper sheet may be formed with a narrow longitudinal region running the length of the sheet by compressing this region of the paper as it passes through compression rollers. This may be done, for example, when the paper is manufactured. Such a region may be of any appropriate width, for example, from less than 1 mm up to 5 or 10 mm, or greater.

In other embodiments the sheets comprising the stack may be different from each other or may include 2, 3, 4, 5 or more perforation pattern variations that, when stacked together, provide for a binding region in the stack. In one embodiment, the stack is comprised of a series of sheets that include perforations. The perforations pass entirely through a sheet. The perforations in any given sheet may form a pattern such as, for example, a straight line. Often, the pattern is in a longitudinal direction, substantially parallel to, or parallel to, a long edge (e.g., spine) of the sheet. Perforations may be of any size that results in a binding region when the sheet is stacked with additional sheets. For instance, a sheet may include perforations having a diameter on a side of less than 1 mm, 1 mm, 2 mm, 3 mm, or 4 or more mm. The perforations can be spaced apart by any distance that forms a binding region while maintaining the structural integrity of the sheet. For example, in some embodiments, perforations may be separated by from 1 to 20 mm. In other embodiments, the perforations may be separated by from 0.5 to 10 perforation lengths (square or rectangular perforations) or from 0.5 to 10 average perforation diameters (circular or oval perforations). In some preferred embodiments, the perforations form a regular pattern with each perforation separated by greater than, less than, or equal to 1, 2, 3, 4, 5, 6, 7, or 8 perforation lengths or diameters. Perforations may, in some embodiments, pass from one edge of a sheet to an opposed edge. In other embodiments, the perforation pattern may only pass over a section or sections of the sheet. For example, a perforation pattern may start a specific distance from one edge, e.g., 1 cm, and continue until a specific distance from an opposing edge, e.g., 1 cm. In other cases, perforation patterns may be interrupted by one or more unperforated or unpatterned areas.

Figure 6:
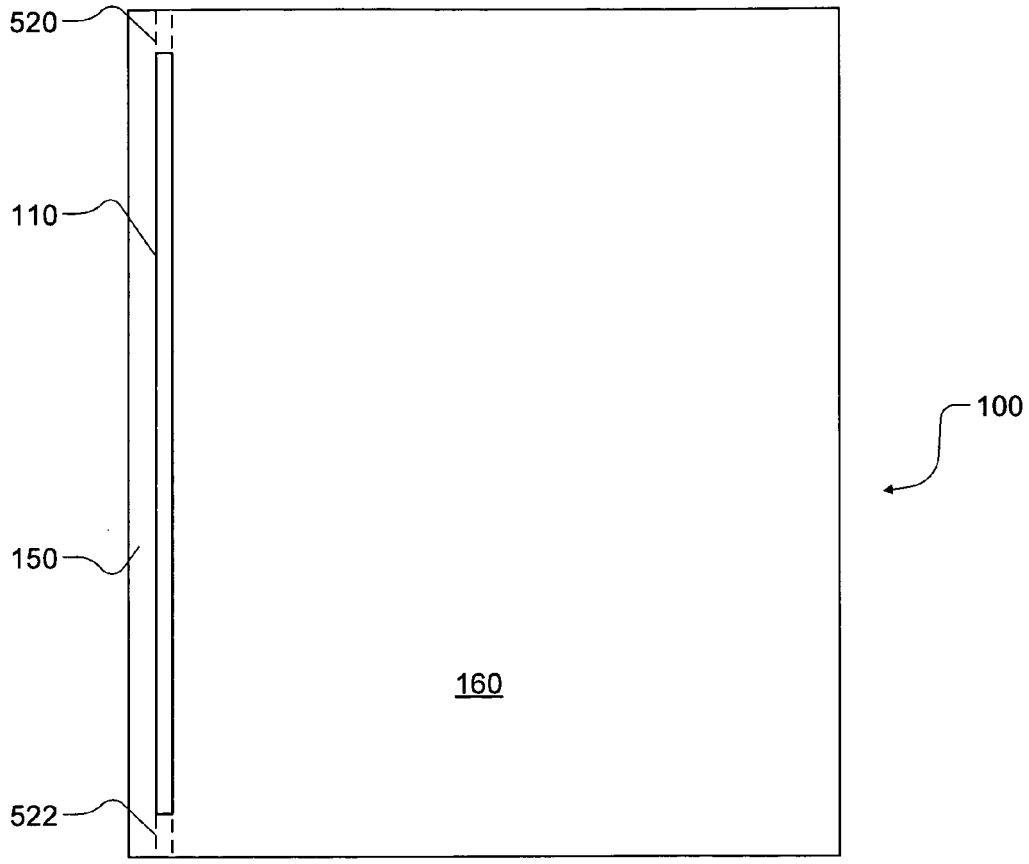
FIG. 6 illustrates schematically a top view of a stack of sheets including a binding region that does not extend from top to bottom of the sheet.
Figure 7:
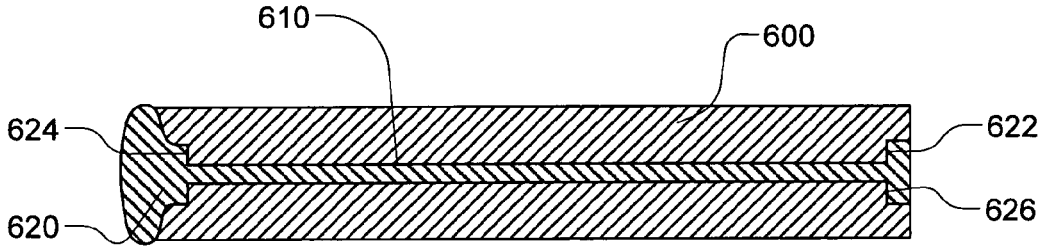
FIG. 7 provides a perspective view of a binder.

As with the embodiment shown in FIG. 6, by leaving an unperforated portion at the top end, bottom end, or both ends of a stack of sheets, the binding region may be bounded at the top and/or bottom by a thicker region. This may provide even greater security for the binder. FIG. 6 provides a top view of a stack of sheets having a binding region 110 and adjacent non-binding regions 520 and 522. Non-binding regions 520 and 522 provide raised sections of the stack of sheets that can help to prevent a binder such as a C- or U-shaped binder from sliding off of the top or the bottom of the stack of sheets. For instance, without sections 520, 522, a binding region 110 that extends from one end of the stack to the other may allow a binder to slide in a direction parallel to the spine of the book unless other securing techniques are used. FIG. 7 illustrates a perspective view of a cylindrical binder 600 having a binder slit 610 extending longitudinally from one end of the binder to the other and expanded binder slits 620 and 622 that are sized to fit over sections 520 and 522 when combined with a stack of sheets as shown in FIG. 6. Non-binding regions 520 and 522 can each provide a ridge, 624 and 626, that interlocks with regions 620 and 622 on the binder. When bound to the stack of sheets 100, the interlocked ridges and expanded slits help to prevent the binder 600 from sliding longitudinally along the stack of sheets. This type of binding region and non-binding region can be used with both hard and softcover books as well as with other embodiments described herein and known to those skilled in the art.

Stacks of sheets that include a binding region may be bound together using any technique that can successfully secure the sheets in a book-type form. For example, the sheets may be clamped, glued or sewn. As shown in FIGS. 4, 8, 9, and 10, for example, the binding region of a stack of sheets may be clamped together using a resilient binder that is positioned lengthwise along the binding edge (spine) of the stack of sheets. The binder retains the sheets in place by applying pressure across the binding region to prevent the removal of one or more sheets from the stack. Because the binding region is typically thinner than an adjoining region of the stack of sheets, the binder is able to more fully grip the sheets and provide a secure binding. In some embodiments, binding a book may include prying open the binder and then allowing the binder to return to its original shape, or close to its original shape, after being positioned over the binding region. Other types of binders may be positioned over the binding region and may be secured by crimping the binder or by fixing the binder in position such as by chemically altering the binder material, such as with heat or radiation.

A stack of sheets can also be bound by sewing. As is known to those skilled in the art, individual sheets or signatures (multiple sheets folded in half along the binding edge) can be sewn together to retain the sheets in book form. Individual sheets may be sewn together using a technique known as "side-sewing" in which holes are formed through a stack of sheets which are then sewn together by passing thread completely through the stack. Side-sewing can be limited, in part, by the thickness of the stack of sheets through which the sewing takes place. Because the present invention can provide for an area of reduced thickness, it can be used with side-sewing to provide for the attachment of a greater number of pages with the same stitch depth. For example, an area of reduced thickness may allow for side-sewing of a 300 page book when previously only a 200 page book was possible, due to the thickness of the sheets. Outside the use of a binding region, the sewing techniques used with the invention can be identical or similar to those known to those skilled in the art.

In other embodiments, the sheets in a stack can be bound together using an adhesive such as a glue or hot-melt adhesive. If the binding region is formed by stacking perforated sheets, adhesive distribution and effectiveness can be improved by applying the adhesive so that it passes through at least some of the perforations so that two or more pages that are not back-to-back (adjacent) may actually be adhered to each other with adhesive. For example, the adhesive may be in contact with one sheet, pass through a perforation in an adjacent sheet and then adhere to a third sheet on the opposite side of the second sheet.

Clamping, sewing and the use of adhesives can be used independently or together in order to bind sheets of a stack together. Other binding methods may also be employed to use or take advantage of a binding region.

Binders of the invention may include a cover or may be used in conjunction with a cover. In some embodiments, covers, or cases, may be similar or identical to traditional soft or hard covers. The cover may pass over and around the binder or the binder can be clamped over a portion of the cover. Additional methods of joining the binder and the cover may include adhesives, stitching, welding and other techniques familiar to those skilled in the art. In some embodiments, the cover may include one or more regions of reduced thickness that can be aligned with the binding region in a stack of sheets and can be bound in place in conjunction with those sheets. For example, a cover having a region of reduced thickness may be clamped in place using a resilient binder. In other embodiments, a flexible cover material without a region of decreased thickness may be deformed by a binder so that it can fit in a depression formed by the binding region of a stack of sheets. A binder or other means can then be used to deform a portion of a cover material into the channel formed by the binding region.

Figure 8:
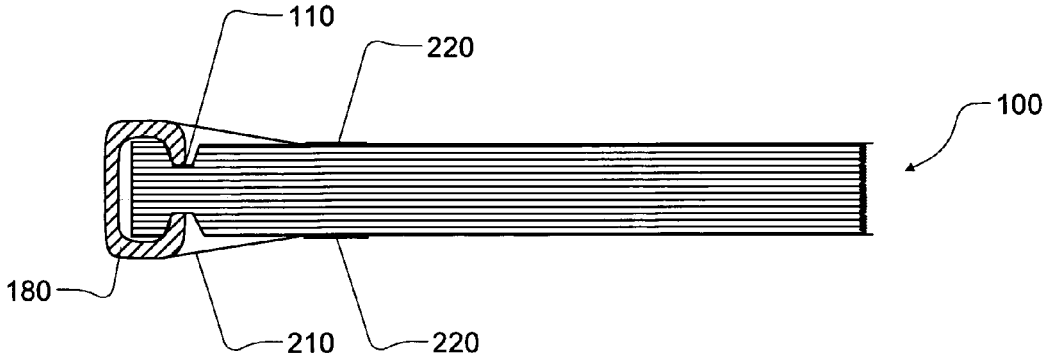
FIG. 8 provides an end view of one embodiment of the invention including a binding region and a binder.
Figure 9:
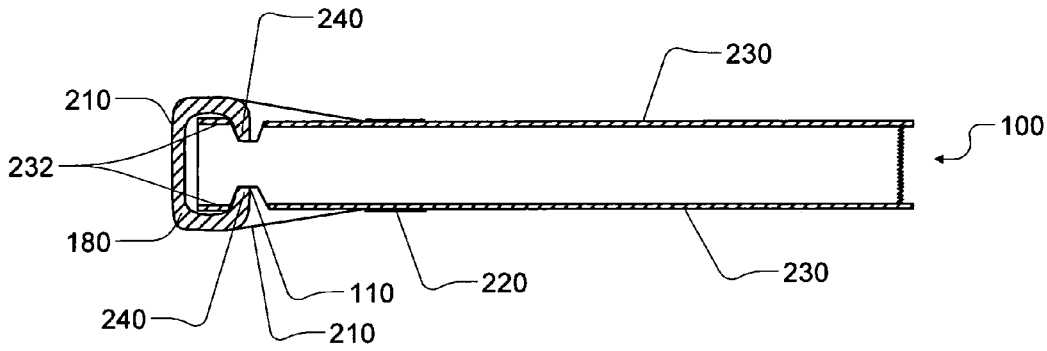
FIG. 9 provides an end view of another embodiment of the invention.

In some embodiments, such as the one shown in FIG. 8, a stack of sheets may be covered with a traditional soft or hardcover and then bound at a binding region 110 by the use of a C or U-shaped binder 180. A binding cover 210 can be wrapped around the binder 180 and joined to, for example, top and bottom pages, or a soft cover, or a hardcover at region 220. At region 220 an adhesive or other joining technique can be used to attach the binding cover to either a cover page and back page or a soft cover or a hardcover. FIG. 9 illustrates an embodiment where a binding cover 210 is used in conjunction with a hardcover 230. Hardcover 230 includes region 232 oriented toward the spine of the book and also may include an area of reduced thickness 240. Area 240 allows binder 180 to be inset deeply into the stack of sheets. Section 232, which is optional, may aid in retaining the cover in place. Absent section 232, binder 180 may still retain the cover in place by indenting the cover into binding region 110, in the stack of sheets. The hardcover 230 may be one piece that wraps entirely around the spine of the book or may be two separate pieces.

Figure 11:
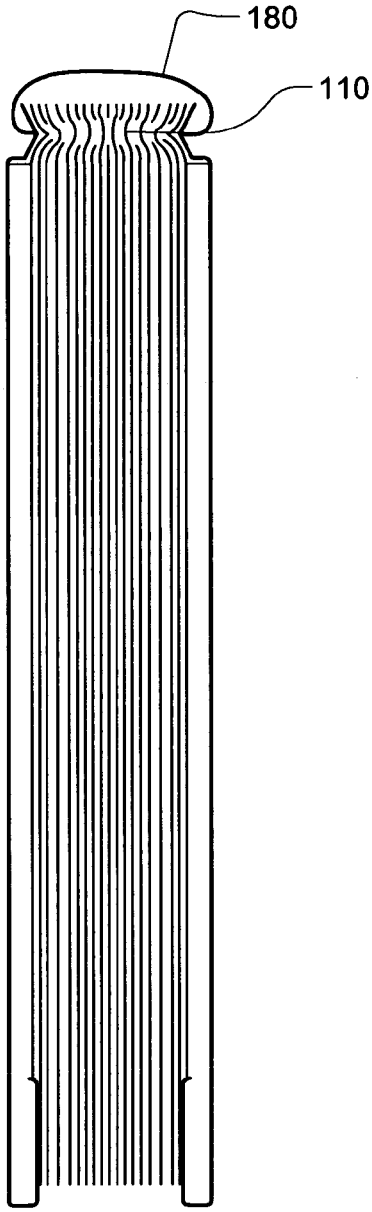
FIG. 11 provides an end view or cross- sectional view of a hard cover book of the invention.
Figure 12:
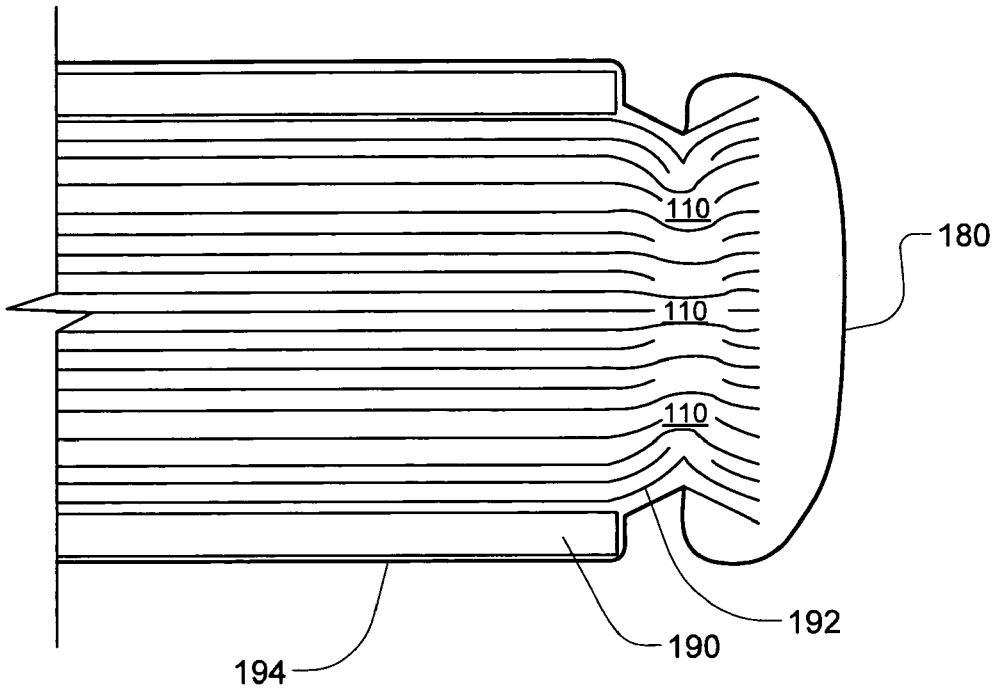
FIG. 12 provides a close-up view of a section of FIG. 11.

FIGS. 11 and 12 provide an embodiment showing a cross-sectional view of a hardcover book including a C-shaped binder 180 that is in compression around the binding region 110 of a stack of sheets. The binding region 110 is of reduced thickness and reduced stack density. Each of the sheets comprising the book passes through the binding region to the spine region of the book. Portions of at least some of the sheets have been perforated in the binding region to provide for a binding region of reduced thickness. The top and bottom covers are separate and could be used with books of different thicknesses.

Figure 10:
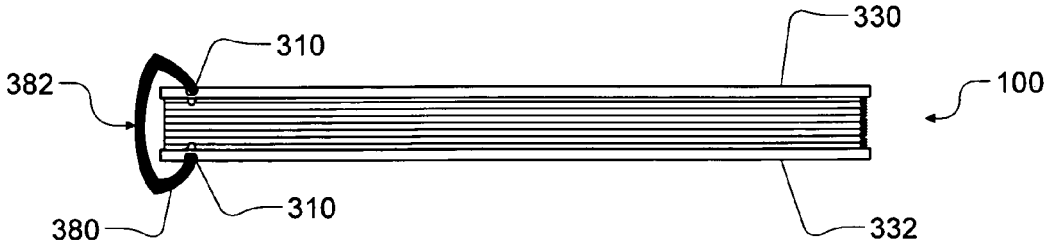
FIG. 10 provides an end view of another embodiment of the invention.

FIG. 10 illustrates another embodiment showing a hardcover bound book including upper cover 330 and lower cover 332. By utilizing separate upper covers and lower covers, the same cover material may be used for books of varied thicknesses. The cover of the book may be properly sized to cover the length and width of the book. However, the thickness of the book may not be important in defining the type of cover that is used as the upper cover 330 and lower cover 332 can be spaced any distance from each other. Different sized binders can be used with stacks of different thickness. Binder 380 is shaped in FIG. 10 to provide a "nail head" finished binding. Binder 380 may include a printing surface 382 on which book information such as title and author can be printed. The binder may be printed or engraved pre- or post-binding and may be printed using conventional techniques known to those skilled in the art such as, for example, screen printing and pad printing. Information may also be printed on a decal or label that can then be adhered to the binder using techniques known to those skilled in the art. Thus, in some embodiments, a finished book including printed information on the spine can be achieved without the use of a binding cover or a traditional one piece book casing. Furthermore, a binder can include color and texture that may compliment the cover. The binder can be covered with, e.g., paper or cloth. For example, the binder may be of a similar color and/or texture to the cover material or may be a contrasting color and texture to the cover material. The binder may be covered or coated with the cover material. In many cases, the binder can be fitted into the binding region so that, when a similar looking material is used for the cover material, the binder and cover material appear as one continuous piece to the reader.

FIG. 12 illustrates an embodiment in which a hard cover book is made using a binder 180 that clamps across the pages of the book at binding region 110. The front cover and the back cover of the book are unattached and are of two different pieces. Each of the front and back cover may be assembled prior to clamping the book together with binder 180. Each cover may consist of a board 190, cover material 194 and inside cover sheet 192. In traditional binding techniques, an end sheet is typically joined to the inside of the hard cover, such as with an adhesive, as a way of joining the cover to the book block. In this embodiment the end sheet is replaced by the inside cover sheet 192 so that the finished book appearance is similar to a traditional book. In this manner, finished covers including board, inside cover sheet and cover material can be made prior to the binding of the book. The cover can be held in place in the same manner as the pages are held in place—by compression of binder 180 across binding region 110. In the case of the cover material, the compression at region 110 may occur across the end sheet and/or the cover material but does not typically include the board. In other embodiments, other covers, such as traditional one piece covers with or without a spine, may be used. In these other embodiments, however, the particular thickness of the book may have to match the size of the spine portion of the cover. With two separate covers for the front and the back, the same covers can be used with books (blocks) of a wide variety of thicknesses. For example, the same pair of covers may be used for covering books having a stack of pages (book block) having a thickness of less than one cm, greater than one cm, greater than two cm, greater than three cm or greater than four cm.

Binders may be of any specific material or materials capable of providing a binding at the binding region. A binder may be of a resilient material such as plastic or metal and may be printable. In cross-section, a binder may be of a variety of shapes including circular, U-shaped, C-shaped, triangular, or square. In some embodiments, a "nail head" shape can be used to mimic the shape of the spine of a traditional one piece hardcover book. Binders may be pried open to allow insertion of a stack of sheets. In some cases, it may be easier to place a binder on a stack with a sliding motion that is parallel to the spine of the finished book. Binders may be made in different sizes for receiving stacks of sheets of different thicknesses. The presence of a binding region and a resilient binder mean that a specific size binder can be used for a variety of thicknesses of stacks of sheets. A single size binder may be used with stacks of sheets varying by as much as 10, 20, 50 or up to 100 pages or more, depending on the type of paper used and the binder that is used with the stack. Binders may be categorized by the number of pages that they may be typically used to bind. For example, a binder may be rated from 1-20 pages, from 20-50 pages, from 50-100 pages, from 100-150 pages or 150-200 pages. Page ratings may be based on a standard page thickness and may be used by those building a book to determine the appropriate size binder for a stack of sheets. In many embodiments, it is the thickness of the binding region of the stack of sheets that is to be matched with a binder, not the thickness of the stack of sheets itself.

Figure 14:
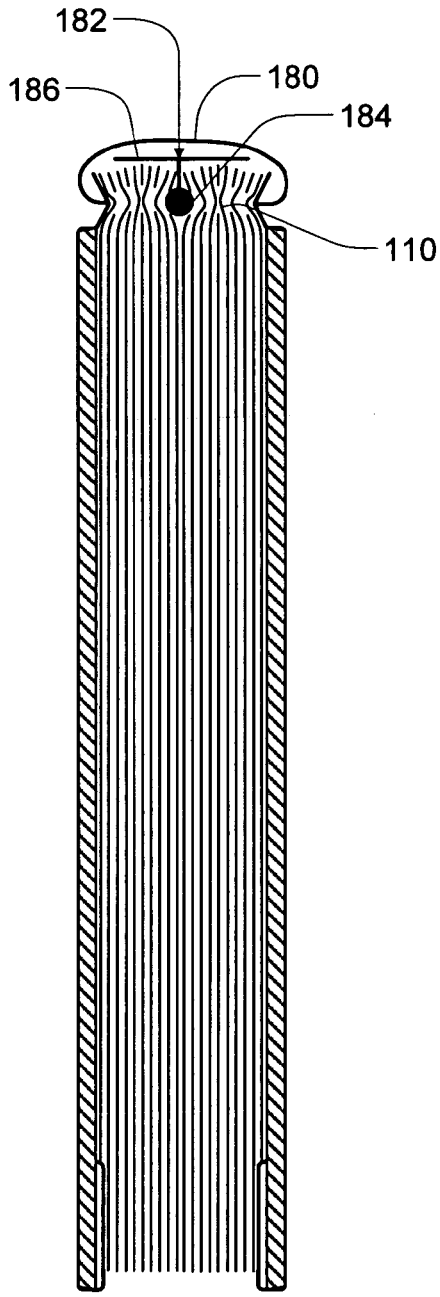
FIG. 14 provides an end view of another embodiment of the invention including a T-extrusion.

FIG. 14 illustrates an embodiment that may be of particular use in certain situations, such as in books of substantial thickness. As shown in FIG. 11, when the book achieves a substantial thickness the entire binding region 110 may not be compressed to as great a degree as it is in a thinner book. In particular, the central portion of the binding region, that is the portion near the middle of the book, may not be compressed as much as the portions near the edges. This lack of compression in the central section may, in some instances, allow for the removal of pages when placed under significant 30 tension. FIG. 14 illustrates an embodiment that uses a "T extrusion" to improve compression of the binding region 110 throughout the thickness of the book. T extrusion 182 may pass through the length of the book or a substantial portion of the length of the book or a portion of the book may include a rod portion 184 that can be, for example, substantially cylindrical. Attached to rod portion 184 can be a T 186 that can help to position and maintain in place rod 184. T extrusion 182 occupies space within the binding region 110 and provides for greater compression of the pages in the binding region without altering the binder. A comparison of FIG. 14 with FIG. 11 shows that the binder 180 in each of the figures is providing the same amount of compression while the sheets in binding region of the embodiment FIG. 14 are compressed to a substantially greater degree than are those in FIG. 11. The use of the T extension 182 can supply means for providing clamping pressure from the interior of the binding region. In the example shown, the T extrusion has essentially divided a large book into two smaller books allowing for more compression across the binding region 110 which can result in, for example, a more securely bound book. A book is not limited to the use of a single T extrusion and T extrusions may be used where ever additional compression of a binding region is desired. Furthermore, the T extrusion may be a single piece or may be two or more pieces positioned at different locations through the binding region. The T extrusion may be made out of any material capable of providing the desired effect and may be, for example, of a metal or polymeric material. In some instances, the T extrusion 182 can be made from molding a polymeric material, for example such as by extrusion molding. T extrusions may also be included in kits that include other components useful in the production of books.

Figure 13:
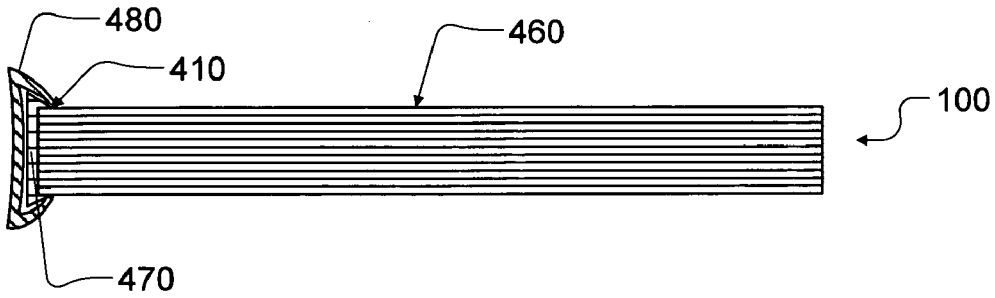
FIG. 13 provides an end view of another embodiment of the invention.

In another embodiment, a binding region may also be formed not by reducing the thickness of a region but by adding thickness to the edge of a stack of sheets located most closely to the spine. For example, by adding an adhesive to a few millimeters of the spine edge of the sheets making up the stack, the spine edge of the stack of sheets can be caused to flare out, thus providing a binding region at which a binder can find purchase. For example, in FIG. 13, binding region 410 can be formed by thickening region 470 of the stack of sheets using, for example, an adhesive or some additional material, or by folding back the edge of the sheet or other portions of the sheet, to provide for a region of greater thickness than is the thickness of the majority of the stack. For example, if stack 460 has a thickness of 1 cm, region 470 may be expanded to be greater than 1 cm, for example, 1.2 cm. In this manner, binder 480 can obtain additional purchase and will be able to retain the pages of the stack of sheets in a secure manner.

In another aspect, software is provided for producing a book. The software may be stored on a computer-executable medium. The software may include code for producing a book that includes a binding region. In one step, the software may set one or more margins of a printer so that pages are printed with appropriate margins for producing a finished book. Software may also provide for printing cover and/or spine labels that may be included in a kit. The finished book may include a binding region and/or a binder as described herein. Software may also be used to program a controller for perforating a sheet or a plurality of sheets for producing a stack that includes a binding region. For example, successive sheets may be alternately punched with different patterns so that when stacked, the perforations produce a binding region. The software may also control a system that provides for flipping over (see FIG. 2) of some sheets, e.g., every other sheet, after the same or a similar pattern has been perforated in multiple sheets. When turned over, a different pattern is apparent that can, in some cases, produce a binding region when the sheets are stacked together with unturned sheets.

In another aspect of the invention, a book and method of making the book are provided in which the book may contain another region that can provide for improved "lay open" or "lay flat" ability of the book.

While it is often preferable to have a book that will lay open to a particular page without closing or flipping pages, it is often difficult to find a book, hard or soft cover, that will do so. Due to the resiliency of the pages and sometimes the cover, the tendency of many books is to close or for a number of pages to flop over to different pages or the beginning or the end of the book. At least some of this tendency is believed to be due to shear stress that develops between adjacent pages when the book is open. In order to keep a book open to a specific page the reader typically must force the book open, such as by holding it open manually or by placing something in contact with the page to weight it down to prevent closing.

Using methods similar to those described herein for forming a binding region, a book can be made that includes a "lay open region" that can, for instance, decrease the tendency of a book to close or change pages when opened. A lay open region is a specific portion of a sheet or stack of sheets that has less sheet material than surrounding regions. Typically, the lay open region runs parallel to the binding of the book and runs the full length of the book. All or most of the sheets may include a lay open region. The lay open region may decrease the spring, or resiliency, of a page or pages so that when the book is opened to a specific page it may stay open to the specific page.

When a standard book is opened to a certain page, at least one of the sheets that comprises the book is temporarily bent (curved) and is stressed so that it is no longer in a substantially single plane as it is when the book is closed. For example, see FIG. 15*c* showing a book with a binding region but without a lay open region. Often, when opened to a specific page, a portion of the page in or near the binding may be curved so that part of the sheet is in a plane at an angle of 30, 45 or even 90 degrees or greater in relation to other portions of the same sheet. Because the page has a tendency to return to its original position, it often does so unless the page is creased or has a force applied to it to keep it in position. This tendency may vary due to the type of binding used. In addition, the tendency to close or flip pages may be even greater near the beginning or the end of a book as the weight of the sheets on the "thick" side can, because all pages are connected, pull pages from the "thin" side over to the thick side, essentially closing the book. The cover, however, may stay open in some instances.

A lay open region can be formed in a book, for example, by reducing the amount of sheet material in a region close to the binding but toward the open side of the stack of sheets. Preferably, the lay open region is positioned in or near an area of maximum sheet curvature when the book is open. A lay open region can be made using, for example, the methods described herein for making a binding region but a book can include either a binding region, a lay open region, or both—but not necessarily both. Unlike the binding region, the lay open region may not be directly compressed by a binder, although, as recognized by those skilled in the art, it may be subject to some compression due to its proximity to the binder. The lay open region can help a book remain open to a selected page without any additional force other than the weight of the page (or pages) itself. By forming an area of reduced mass, such as by perforating or grinding individual sheets, the resiliency of the page can be reduced so that the tendency of the sheet to return to its original position is not great enough to overcome the weight of the sheet. In some embodiments, the lay open region is positioned so that it does not detract from the aesthetic aspects of the book. For instance, the lay open region may be close enough to the binding that it is not visible to the reader when the book is open. In some cases, the lay open region may be a fraction of a page width from the binding edge of the page. For instance, the lay open region may be about 0.025, 0.05, 0.1, 0.15, 0.25 or greater page widths from the binding edge of the page. In one example, the lay open region on a page having an 8 inch width is about 0.5 inch, or about 0.0625 page widths, from the binding edge of the page (sheet). In other embodiments, the lay open region may be about 1, about 2, about 3, about 5, about 7, about 10, about 15, about 20 or about 25 mm or greater from the binding. Lay open regions may be narrower (less than 3 mm, less than 2 mm or less than 1 mm) than some binding regions as the lay open region may not be compressed and may suffice by merely supplying an area of weakness in the sheet or sheets. In other embodiments, the lay open region may be thicker, eg, greater than 2 mm, greater than 5 mm or greater than 10 mm. This thicker lay open region may allow for a more gradual curving of open pages through the lay open region, rather than the sharper curve that can develop in some cases with thinner regions. Lay open regions may, in some cases, run the length of the sheet or may extend over only a portion of the sheet. If material is removed from the sheets in order to form the lay open region, the amount of material may vary with the characteristics of the sheet. For example, a strong sheet with a high level of resiliency may require the removal of a greater amount of material than does a sheet of less resiliency. Preferably, the amount of material removed to form the lay open region is not so great as to weaken the sheet to the point where it will tear at the lay open region under conditions of normal use.

Figure 15A:
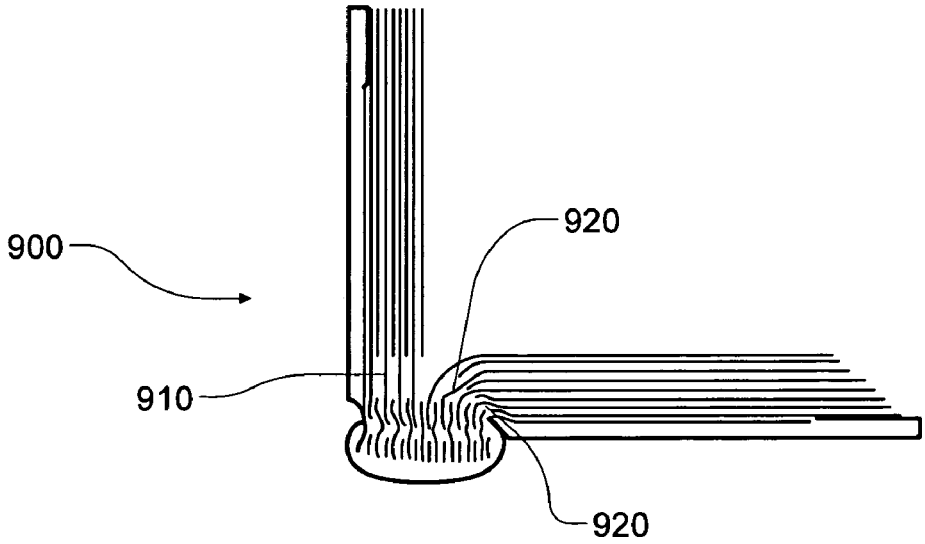
FIG. 15*a* provides an end view of a book including an open region.
Figure 15B:
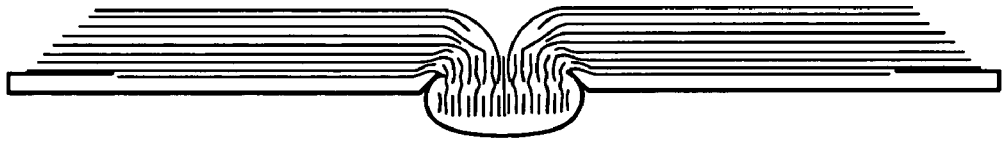
FIG. 15*b* provides another end view of a book including a lay open region.
Figure 15C:
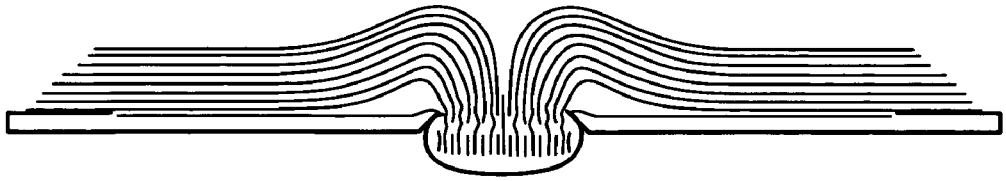
FIG. 15*c* provides an end view of a book not including a lay open region.
Figure 16:
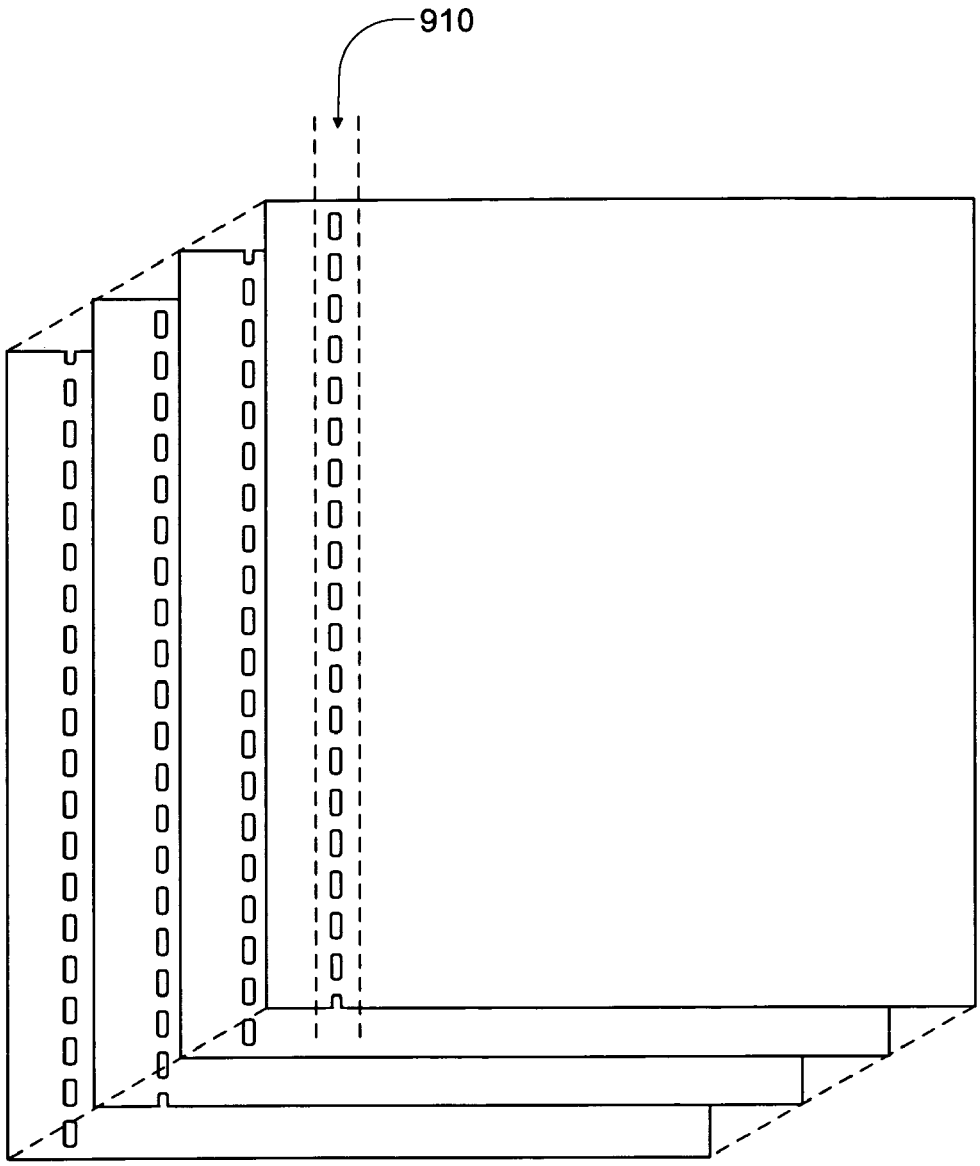
FIG. 16 provides an exploded view of four sheets perforated to form a lay open region.
Figure 17:
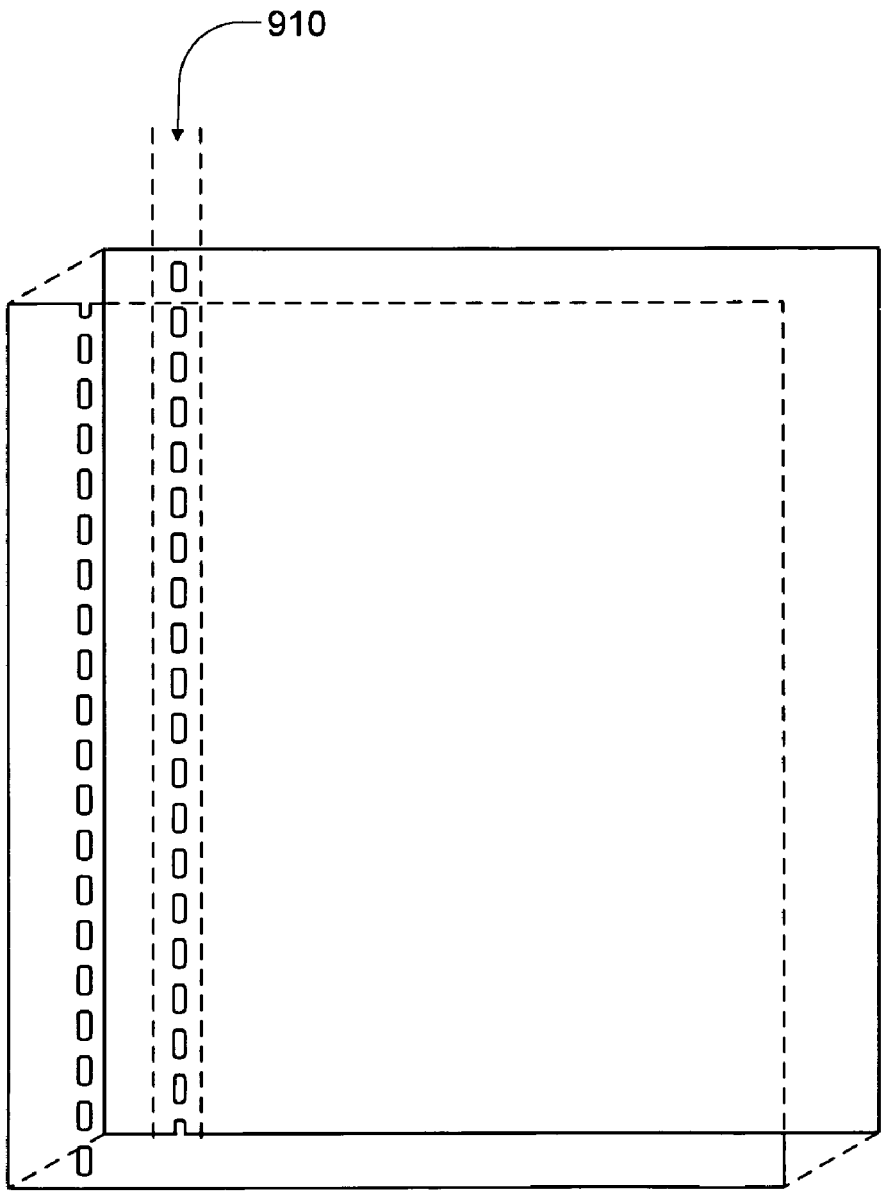
FIG. 17 provides an exploded view of two sheets perforated to form a lay open region when stacked.
Figure 18:
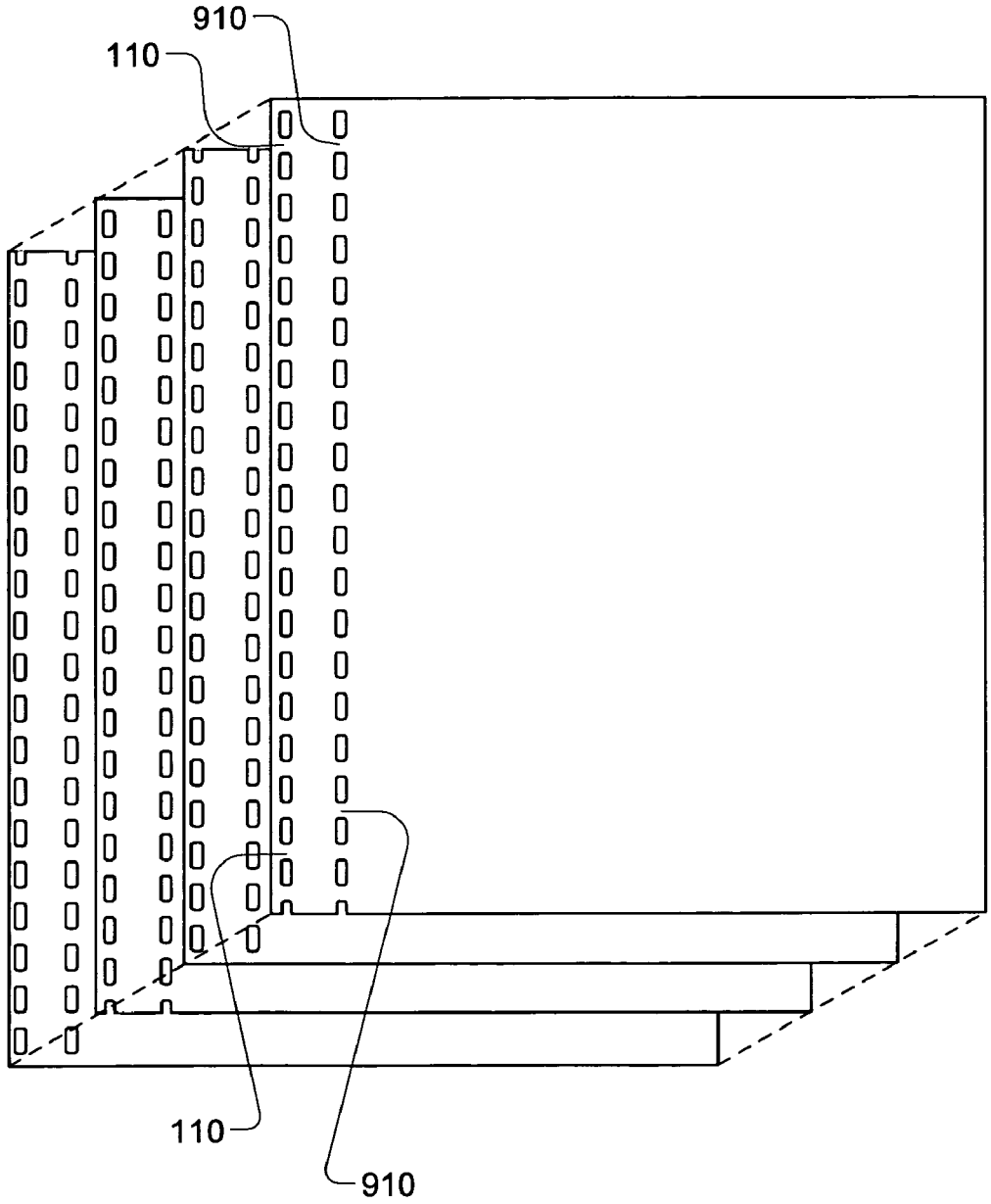
FIG. 18 provides an exploded view of four sheets perforated to form both a lay open region and a binding region.
Figure 19:
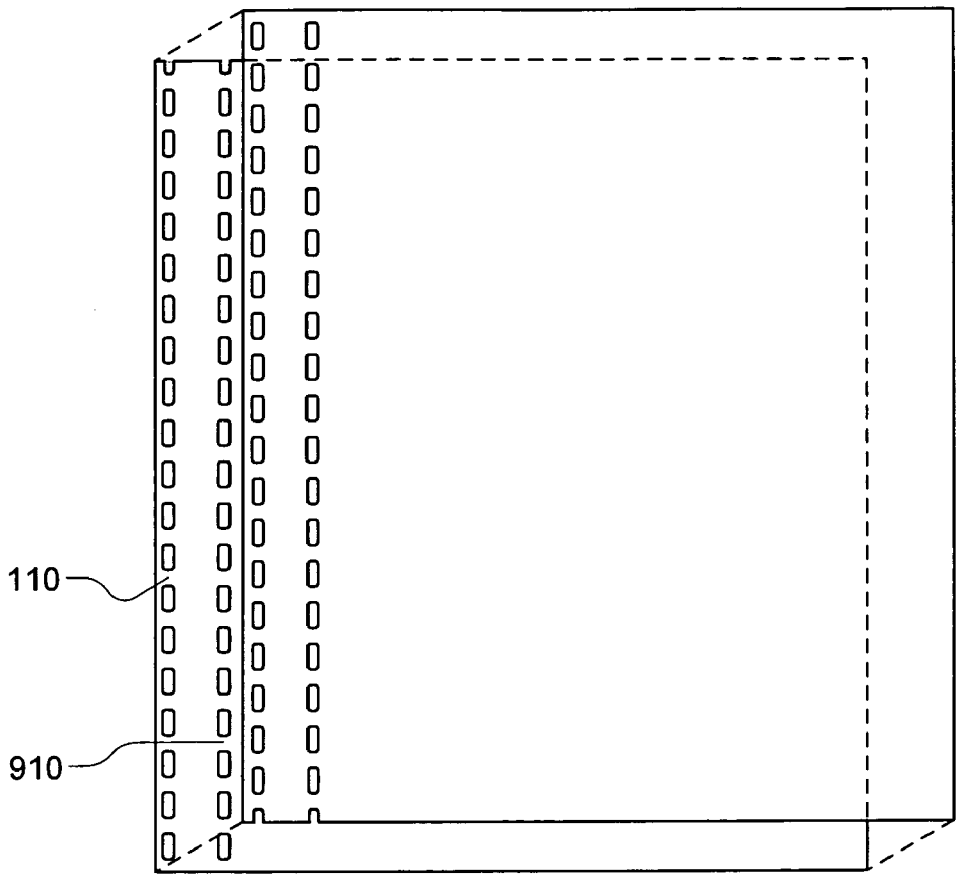
FIG. 19 provides an exploded view of two sheets perforated to form both a binding region and a lay open region.

FIGS. 15*a* and *b* show end views of two books incorporating lay open regions. Book 900 includes a lay open region extending through the thickness of the book (except for cover). Section 910 shows a lay open region in half of a book when the pages are not open. Section 920 illustrates how pages can spread out flat at the lay open region when the book is opened. FIG. 15*b* provides an illustration of a book having both a binding region and a lay open region, and when compared to FIG. 15*c* shows how pages are allowed to lay flat when the lay open region is employed. FIGS. 16 and 17 provide exploded views of sets of sheets that have been perforated to form a lay open region. FIGS. 18 and 19 provide exploded views of a plurality of sheets that have been perforated for both a binding region and a lay open region. The dashed lines in FIGS. 16 and 17 indicate the approximate position of the lay open region 910 on the sheet.

In preferred embodiments, the lay open region includes adjacent sheets having misaligned perforations, similar to preferred perforated designs for a binding region. Preferably there are open spaces, as opposed to contact, between adjoining sheets, to reduce any resistance due to shear stress between the sheets. Misaligned perforations may be preferred for a lay open region because aligned perforations leave substantial portions of adjacent sheets in contact with each other, contributing to shear stress and other forces between the pages that can contribute to the page turning and closing. Pages may not bend as easily when perforations are aligned compared to when perforations are misaligned, even if the perforation sizes are equal and the total amount of material removed through perforating is the same. Typically, less contact area between adjacent sheets leads to a better lay open region. Therefore, in some embodiments, perforation patterns in adjacent sheets are designed so that there is little or no contact between adjacent sheets at the lay open region. For example, in one embodiment, adjacent sheets may include perforation patterns that are mirror-images of each other so that, in the lay open region of the stack, where there is paper in one sheet there is a perforation in the other, and vice versa.

In some embodiments, for instance with soft cover books in particular, the cover material may also include a lay open region. For example, the cover material may be scored or have some material removed in the lay open region in order to reduce the tendency of the cover to spring back to a closed position. Any technique that allows the cover to remain open can be used and may often be used in combination with a lay open region in the sheets themselves.

In one aspect, a kit is provided that can include sheets of paper with pre-formed lay open regions, such as a perforated lay open region. The kit can also include a binder and instructions for making a book that includes a lay open region.

In some embodiments, a book or a stack of sheets may include both a binding region and a lay open region. Likewise, sheets and reams of sheets may be supplied with binding region(s), lay open region(s), or both.

The binding methods and devices described herein provide for a book that may include securely bound pages, a finished professional look and the ability to achieve these and other advantages using available paper and methods and techniques that can be used by those without specific training and, in particular, can be used under circumstances where traditional binding techniques may be expensive or difficult to obtain.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B", when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of", when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one act, the order of the acts of the method is not necessarily limited to the order in which the acts of the method are recited.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A book comprising:

a stack of sheets, the stack having a thickness, a binding edge and an opposed non-binding edge;

a binding region defining a cross section through the thickness of the stack and substantially parallel to and proximate the binding edge, the binding region having a first stack density;

a second region passing through the thickness of the stack between the binding region and the binding edge, the second region having a second stack density, the second stack density being greater than the first stack density; and a resilient binder in compression around the binding region;

wherein a portion of a first sheet in the stack is perforated in the binding region of the first sheet and a portion of a second sheet adjacent to the first sheet in the stack is perforated in the binding region of the second sheet, at least some perforations in the second sheet are misaligned with perforations in the first sheet and the perforations in the first sheet are intertwined with non-perforated sections of the second sheet to interlock the first and second sheets together.

2. The book of claim 1 wherein the book comprises a third sheet and wherein the binding region of the third sheet is perforated and at least some of the perforations are misaligned with perforations in the first sheet and with perforations in the second sheet.

3. The book of claim 1 wherein less than 50% of the perforations in the first sheet are aligned with the perforations in the second sheet.

4. The book of claim 1 wherein the binding region exhibits a thickness that is less than about 80% of the thickness of the second region when equal pressure is applied across each region.

5. The book of claim 1 wherein the binding region exhibits a thickness that is at least about 1 mm less than the thickness of the second region when equal compression pressure is applied across each region.

6. The book of claim 1 wherein the book comprises at least 10 sheets.

7. The book of claim 6 wherein the sheets are paper sheets.

8. The book of claim 7 wherein at least a plurality of the sheets are printed on two sides.

9. The book of claim 1 further comprising a cover material.

10. The book of claim 1 further comprising a lay open region.

11. A method of binding comprising:

providing a first sheet having a first binding edge and a first pattern of perforations proximate the binding edge;

providing a second sheet having a second binding edge and a second pattern of perforations proximate the binding edge, the second pattern being different from the first pattern;

providing a third sheet, the third sheet having a third pattern of perforations, the third pattern being different from each of the first and second patterns;

stacking the first sheet, the second sheet and the third sheet together to form a stack;

clamping the stack with a resilient binder at a portion of overlap between the first pattern, the second pattern and the third pattern.

12. A method of binding sheets of paper together, the method comprising:

providing a plurality of first sheets, each of the first sheets having a first binding edge and a first pattern of perforations proximate the binding edge;

providing a plurality of second sheets, each of the second sheets having a second binding edge and a second pattern of perforations proximate the binding edge, the second pattern being different from the first pattern;

stacking the plurality of first sheets and the plurality of second sheets together to form a stack;

clamping the stack with a resilient binder at a portion of overlap between the first pattern and the second pattern; and at least partially filling perforations in each sheet of the plurality of first sheets with paper from an adjacent sheet of the plurality of second sheets.

13. The method of claim 12 wherein the portion of overlap has a thickness and clamping reduces the thickness of the portion of overlap to less than 80% of the thickness of a portion of the stack that does not include perforations.

14. The method of claim 12 wherein clamping the stack includes clamping a cover material on the stack.

15. The method of claim 12 further comprising interlocking adjacent sheets together.

* * * * *